US005765331A

United States Patent [19]

Chang

[11] Patent Number: 5,765,331

[45] Date of Patent: Jun. 16, 1998

[54] LIGHT WEIGHT WALL STRUCTURE FOR USE IN BUILDINGS WITH A PROTECTION PLATE

[76] Inventor: Fu-Chuan Chang, 4D-11, Taipei World Trade Centre No. 5, Hsin Yi Road, Sec. 5, Taipei, Taiwan

[21] Appl. No.: 786,591

[22] Filed: Jan. 21, 1997

Related U.S. Application Data

[62] Division of Ser. No. 246,696, May 20, 1994, Pat. No. 5,595,035.

[51] Int. Cl.[6] ..... E04B 9/00

[52] U.S. Cl. ..... 52/348; 52/363; 52/448; 52/481.2; 52/675; 52/726.3

[58] Field of Search ..... 52/348, 352, 356, 52/361–363, 444, 447, 448, 481.2, 489.1, 450, 645, 656.1, 670, 673–675, 712, 726.1, 726.3, 127.2, 449

[56] References Cited

U.S. PATENT DOCUMENTS

| | | | |
|---|---|---|---|
| 1,568,314 | 1/1926 | Buttress et al. | 52/449 X |
| 1,668,869 | 5/1928 | Routt et al. | 52/449 |
| 1,726,696 | 9/1929 | Dean | 52/674 |
| 1,840,537 | 1/1932 | Siebenlist | 52/674 |
| 2,047,236 | 7/1936 | Thomas . | |
| 2,173,721 | 9/1939 | McGee | 52/348 |
| 2,412,744 | 12/1946 | Nelson | 52/361 X |
| 3,394,514 | 7/1968 | Lindner | 52/448 X |
| 4,112,648 | 9/1978 | Suzuki et al. | 52/448 X |
| 4,695,033 | 9/1987 | Imaeda et al. | 52/674 X |
| 5,152,118 | 10/1992 | Lancelot | 52/726.1 |
| 5,308,184 | 5/1994 | Bernard | 52/726.1 X |
| 5,417,023 | 5/1995 | Mandish | 52/348 |
| 5,595,035 | 1/1997 | Chang | 52/348 |

*Primary Examiner*—Lanna Mai
*Attorney, Agent, or Firm*—W. Wayne Liauh

[57] ABSTRACT

An improved light weight wall structure for buildings is disclosed. It contains: (a) a skeletal frame having a plurality of posts for quick assembly; (b) a plurality of gusset sub-panels and base board sub-panels disposed in overlapping and alternate relationship fastened to the skeletal frame; (c) connection means provided in each junction between adjacent sub-panels for securely adjoining the sub-panels together; (d) a slurry retention device disposed on at least one major surface of a selected number of sub-panels; (e) a wall facing layer applied to the sub-panels in the form of a setable slurry, so as to increase the strength of the wall structure; and (f) a protection plate mounted on a portion of the wall structure that is most likely to be damaged. The protection plate comprising a protection panel, two inlaid plates extending on both edges of the protection panel, respectively, a base plate at an end of the inlaid plate parallel to the protection panel for retaining the inlaid plates in the wall facing layer.

11 Claims, 12 Drawing Sheets

LIGHT WEIGHT WALL STRUCTURE FOR USE IN BUILDINGS WITH A PROTECTION PLATE

This application is a divisional application of Ser. No. 08/246,696 filed on May 20, 1994 now U.S. Pat. No. 5,595,035.

FIELD OF THE INVENTION

This invention relates to a light weight wall structure for use in buildings and, more particularly, to such a structure characterized by improved structural strength and permitting quick construction.

BACKGROUND OF THE INVENTION

Wall structures using light weight steel-frames, are normally faced with plaster board or concrete slabs laid on trusses of light steel frames to form a surface on a partition wall. These walls are defective in that they are lacking in strength, possess little aesthetic appeal, poor endurance, and in the event of earthquakes or other vibrations create pressure on the structures which can not be dispersed thereby creating wall cracks which will appear irregular. In the event of excessive vibration, the wall face could become severely cracked and dangerous. The wall may collapse. It is also expensive to patch or repair a damaged wall.

Recently new construction methods of wall have become known that relate to placing metal base boards on a wall skeletal and spraying a desired thickness of slurry on the metal base boards to form the wall. As the wall is reinforced with metal base boards, its strength is increased. However, because there is no connection between adjacent base boards, the joints therebetween could easily become loose due to vibration or other external forces applied to the wall so that the wall would become damaged. Further, when the wall face is being formed from the slurry, it is necessary to install conventional leveling or thickness datum members for laying slurry. The work procedure is therefore troublesome and requires experienced workers to perform it. Therefore such procedures are complicated and expensive.

In addition to the aforesaid defects, upon completion, the conventional wall face could easily suffer from cement lifting from the frame or cracking due to impacts by external forces. Once the wall face has suffered damage, not only is its appearance affected but it also requires expensive and time consuming repair. For this reason the part of the wall most likely to be hit is often covered in large protection plates to prevent the wall face from being damaged.

However because such protection plates are only stuck to the wall face, they could break away from the wall face due to slight knocks. Very poor protection is given by these plates and they are not sufficiently durable for normal use.

Conventional light weight steel-framed structures usually include I-bar or U-bar steel to form posts in association with a number of beams fixed together to form a frame. Because the posts and beams need to be large in length as well as in thickness due to the requirement of strength, they are not convenient to transport and assemble. Because of restrictions in the method of construction, it is not possible to adopt a round-bar or a square-bar sectional steel which is of greater structural strength, not to mention the use of round or square tube steel. Because of construction complexity, the waste of time and cost, and building load problem, the conventional RC structure is not sufficiently efficient, high strength, low weight for the construction of modern buildings. For this reason the construction of modern buildings avoids the use of conventional RC techniques as possible in order to reduce the weight and difficulty of construction. Builders have even avoided using RC structure partitions in order to prevent elastic pressure from steel girders. It will be appreciated that many attempts to pursue alternatives have been made without success.

In view of the aforesaid defects in relation to the prior art of light weight steel-framed wall structures, the inventor therefore has devoted himself to research and development based on related experience in the construction and manufacture of relevant products over the years, and has successfully developed the present invention through persistent testing and improvement.

SUMMARY OF THE INVENTION

One object of this invention is to provide a light weight framed wall structure with good structural strength and facility for quick construction.

Another object of this invention is to provide a light steel-framed wall structure formed by base board sub-panels with high completeness and without the necessity of establishing a thickness datum for the wall face.

Still another object of this invention is to provide a light steel-framed wall structure with a quick-assembly light steel frame to improve construction over the conventional RC structure.

Still another object of this invention is to provide a light steel-framed wall structure that can offer greater resistance to damage.

These and other objects and advantages of the present invention will become apparent to those skilled in the art after considering the following detailed specification together with the accompanying drawings and the scope of the invention is defined in the appended claims.

DETAILED DESCRIPTION OF PREFERRED EMBODIMENT

Figure 1:
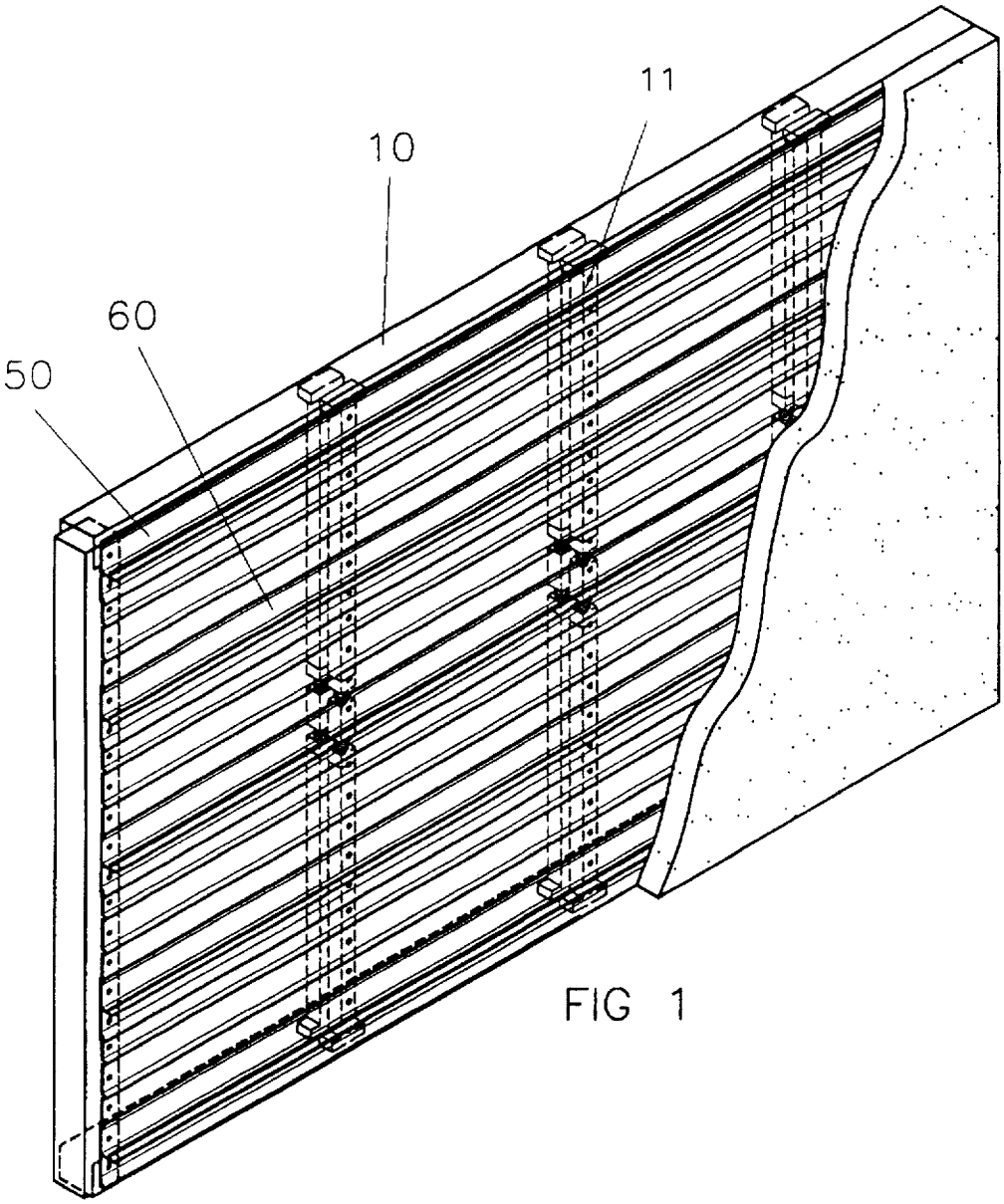
FIG. 1 is an elevational view of the present invention.

Referring to FIG. 1, the light weight steel-framed wall structure comprises a number of gusset sub-panels 50 and base board sub panels attached to a skeletal frame 10. A wall face is formed by placing slurry on the sub-panels in an appropriate thickness.

Figure 3:
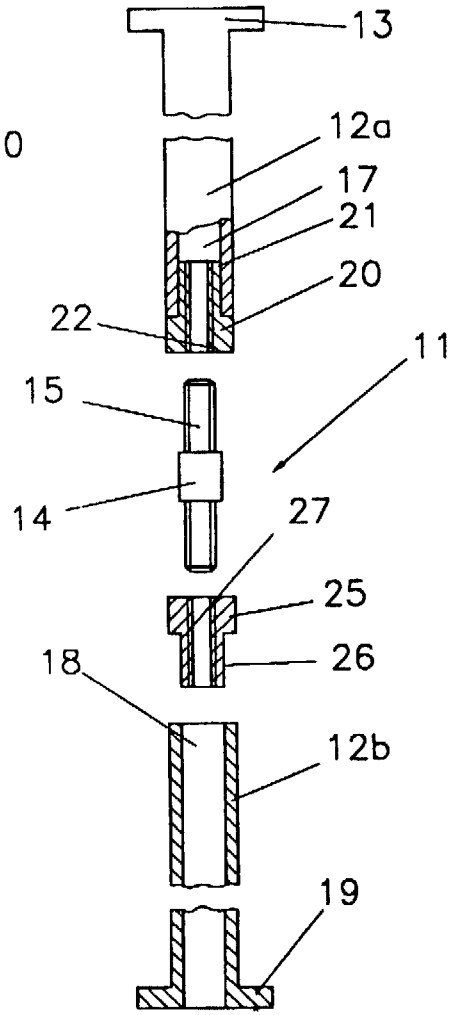
FIG. 3 is a sectional view of built-up posts according to the present invention, showing how said built-up posts adopt three blocks in combination.
Figure 2:
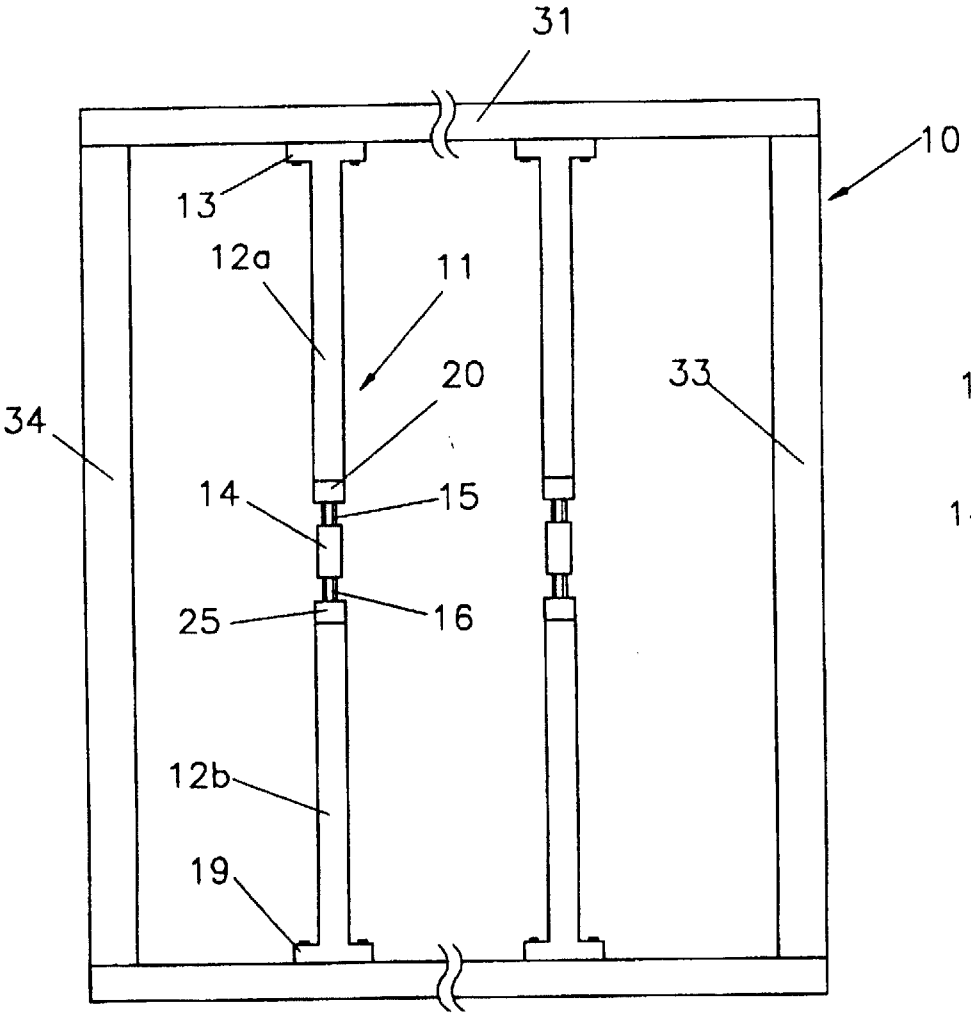
FIG. 2 is an assembly view of the wall skeletal, showing the embodiment of wall skeletal composed of base board sub-panels according to the present invention.

Referring to FIGS. 2 and 3, the skeletal frame 10 comprises built-up posts 11 and adjacent steel poles 33 and 34. The built-up post 11 includes an upper post 12*a*, an intermediate post 14 and a lower post 12*b*. The adjacent steel poles 33 and 34 define the limit of the ends of the wall. Built-up posts 11 in association with the upper and lower steel girders (or floors) 31 and 32 may produce a prop and a tie as desired to form an integral solid skeletal wall.

For practical application, the built-up posts may include multiple blocks, and the sectional shape of each block, except the threaded portion, can be of any cross sectional shape. The best structural strength is obtained by using hollow round tubes or square tubes since they have the advantage of being light weight and strong. Alternatively, solid round or square sectioned columns can also give ideal strength.

Referring to FIG. 3, said built-up post 11 includes the upper post 12*a*, the intermediate post 14, the lower post 12*b*, an upper screw bush 20 and lower screw bush 25. The upper post 12*b* resembles a long column, and includes a plate 13 on one end and a hollow chamber 17 on the other end. The upper screw bush 20 resembles a hollow column which fits inside the hollow chamber 17 of said upper post 12*a*, and has internal thread 22 axially through, the center. Said lower post 12*b* resembles a long column similar to said upper post 12*a*, including a plate 19 on one end and a hollow chamber 18 on the other end. The lower screw bush 25 resembles a hollow column and fits inside the hollow chamber 17 of said upper post 12*a*, and further has an internal thread 27 axially through the center. The thread is opposite to the thread of the internal thread 22 on said upper screw bush 20 (i.e. one is a left-handed thread while the other is a right-handed thread). The intermediate post 14 resembles a long column, both ends having long threads 15, 16 of opposite direction for screwing up of respective internal threads 22, 27 of upper and lower screw bushes 20, 25.

Said built-up post may be constructed quickly into a skeletal partition wall between upper and lower steel girders (or steel plates ) 31 and 32 as shown in FIG. 2, and the following construction steps are taken: inking two parallel lines on the upper and lower steel girders (or floor) 31, 32 as guides for the erection of the built-up posts 11 on both sides of the wall; erect steel poles 33, 34 at both ends between the parallel lines to define the ends of the wall; fix the plates 13, 19 of the upper and lower posts 12*a* and 12*b* between the parallel lines marked on upper and lower steel girders (or floor) 31, 32; with screws or nails 40 (or steel nails) by means of a power drill or hammer; install the intermediate post 14 by inserting the upper and lower screw bushes 20, 25 into the hollow chambers 17, 18 of the upper and lower posts 12*a*, 12*b* respectively. The screw bushes 20, 25 are axially slidable in the hollow chambers without being rotatable. Screw up the long threads 15, 16 of intermediate post 14 into the internal threads 22, 27 of the upper and lower screw bushes 20, 25 respectively to join together the posts 12*a*, 14 and 12*b*. Because the spacing between the upper and lower posts is adjustable, it is very convenient for fast installation.

Upon installation of each built-up post 11, the intermediate post 14 is screwed up. Because the long threads 15, 16 on said intermediate post 14 are of opposite thread directions when the intermediate post 14 is rotated, the upper and lower screw bushes 20, 25 will be pushed outwardly and accordingly the upper post 11 and lower post 12*b* will be locked apart (or if the intermediate post 14 were turned in the opposite direction to cause said upper and lower posts to be pulled towards each other). The whole structure may thus carry out the function of a prop. It should be noted that, because there are many built-up posts 11 erected between said upper and lower steel girders (or floors) 31, 32, once each intermediate post 14 is screwed up the force sustained by the whole structure must be even. Therefore screwing up must be done in order (i.e. each intermediate post 14 and post 11 should be screwed up progressively so as to ensure that the prop is well screwed up) to ensure the whole structure sustains an even force. A complete built-up steel frame is thus formed.

A number of beams can then be fastened to the post with self-tapping screws to reinforce the structure. However, the skeletal formed according to the present invention together with base board sub-panels made of alloy plates is adequate for giving ideal strength so that reinforcement by additional beams is not necessary. Since additional reinforcing beams can be omitted and construction procedure is simplified work and assembly is carried out relatively rapidly.

Figure 4:
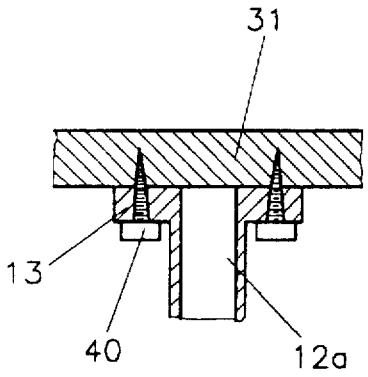
FIG. 4 is a part perspective view of wall skeletal, showing how built-up posts and top steel frame are nailed together.
Figure 5:
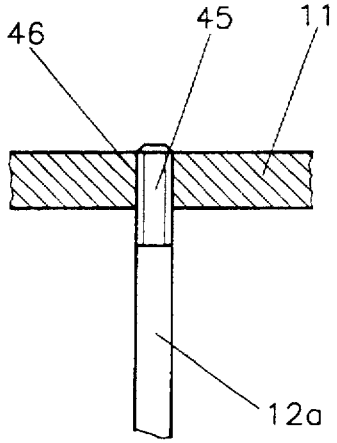
FIG. 5 is a part perspective view of another embodiment of the wall frame, showing built-up posts and top steel frame screwed together.
Figure 6:
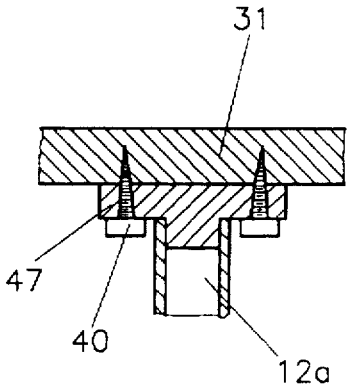
FIG. 6 is a part perspective view of another embodiment of the present invention, showing built-up posts adopt plates in connection with the upper section of posts separately.

The integration of built-up post 11 with upper and lower steel girders (or floors 31, 32), except for fixing by screws or nails 40 with plates 13, 19 as shown in FIG. 4, may include the change of the plate 13 into a stud 45 for screwing up with thread holes 46 on the steel girder 31 as shown in FIG. 5, or other method available for quick assembly to attain an equivalent result. In addition, for mass production the plates may be replaced by a movable assembly of plate member 47 with upper and lower posts 12*a*, 12*b*, in which one end has smaller diameter for fitting into the upper and lower posts 12*a*, 12*b* and the other end has a plate portion projecting over an end for fixing on steel girders (or floor) 31, 32.

According to the present invention, because the upper and lower screw bushes 20, 25 are movably fitted in the hollow chambers 13, 18 of the upper and lower posts 12*a*, 12*b* respectively, the upper and lower posts 12*a*, 12*b* can be cut as necessary to make them suitable for any uneven ground or ceiling. Each member can be made individually for assembly on site to increase production efficiency of components and to lower waste due to work error. Upper and lower bushes 20, 25 may be omitted if the dimensions exposed are a little different or if solid tubes are selected for direct tapping.

The skeletal wall frame according to the present invention can be readily assembled and has advantages such as light weight and high strength, and further it may enable tight integration of overall strength by means of a locked prop to prevent local breakage and therefore to offer firm support to the wall boards of the present invention. In addition, the aforesaid built-up post 11 may be used as the skeleton of the built-up wall or for other purposes such as a support for the floor or decoration material and for the assembly of scaffolding.

Figure 7:
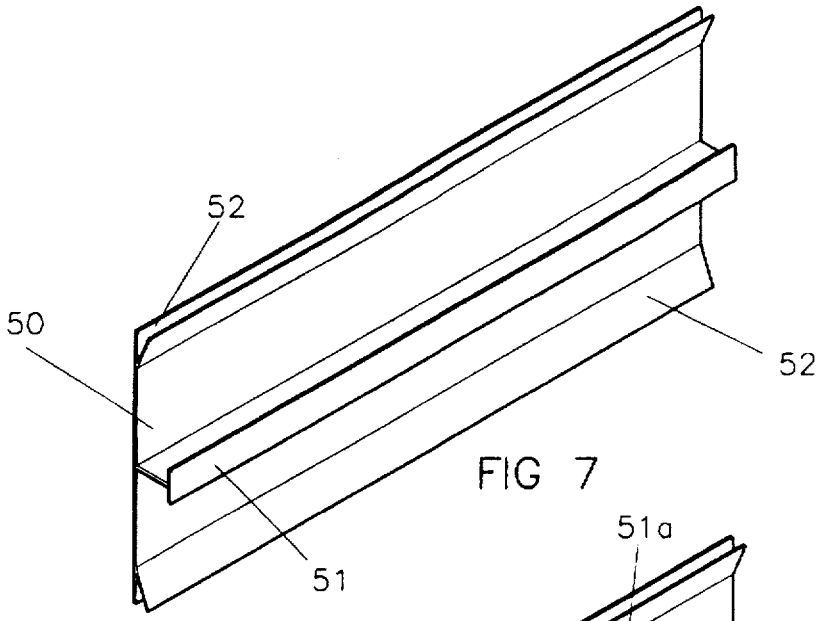
FIG. 7 is an elevational view of the gusset sub-panels used in the present invention.

Referring to FIG. 7, the gusset sub-panel 50 of the present invention is a long and narrow sheet; the reverse side is flat for attachment with the wall frame while the front surface has a number of retention members 51 for increasing the retention of slurry on the wall surface. Two edges of the front surface of the gusset sub-panel so have an extension plate 52 extending outwardly and upward obliquely, the height of the extension plate 52 is greater than the thickness of said base board sub-panel 60 so that the spacing between with front surface of said gusset sub-panel 50 may be set to engage with the edge of said base board sub-panel 60 to enable said two plates to connect together firmly.

Figure 7A:
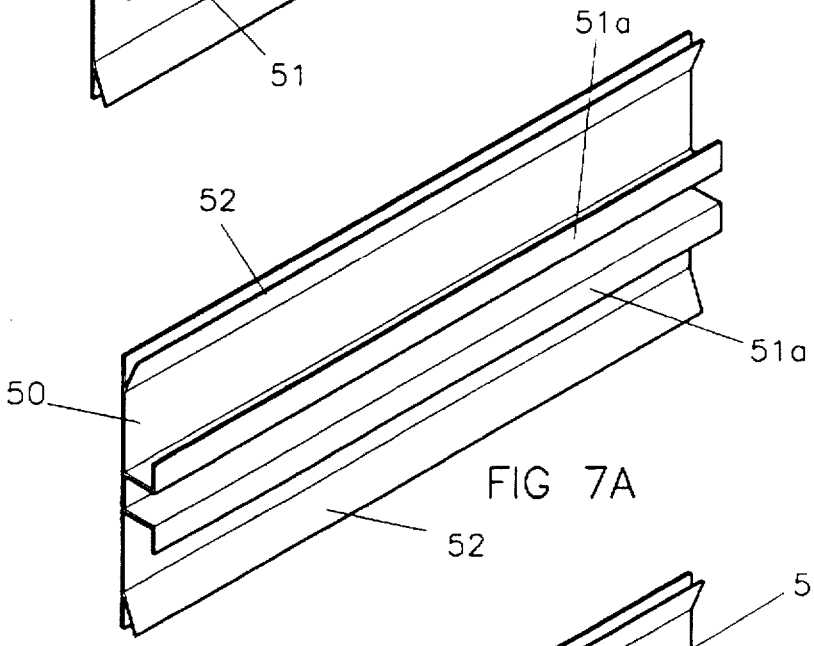
FIG. 7A is an elevational view of the embodiment showing the gusset sub-panels of the present invention including inverted "L" retention sheets.
Figure 7B:
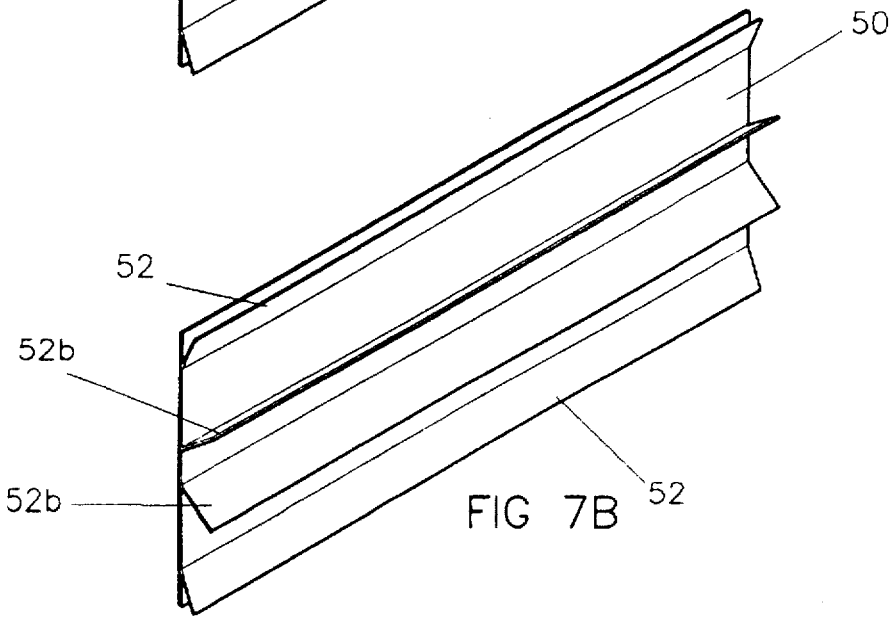
FIG. 7B is an elevational view of the embodiment showing the gusset sub-panels of the present invention including bevel retention sheets.
Figure 7C:
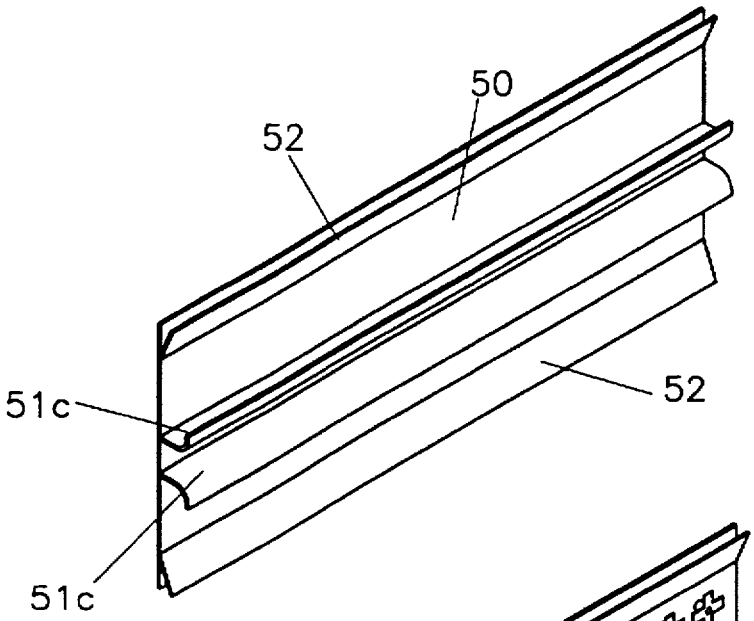
FIG. 7C is an elevational view of the embodiment showing the gusset sub-panels of the present invention including hook retention sheets.
Figure 7D:
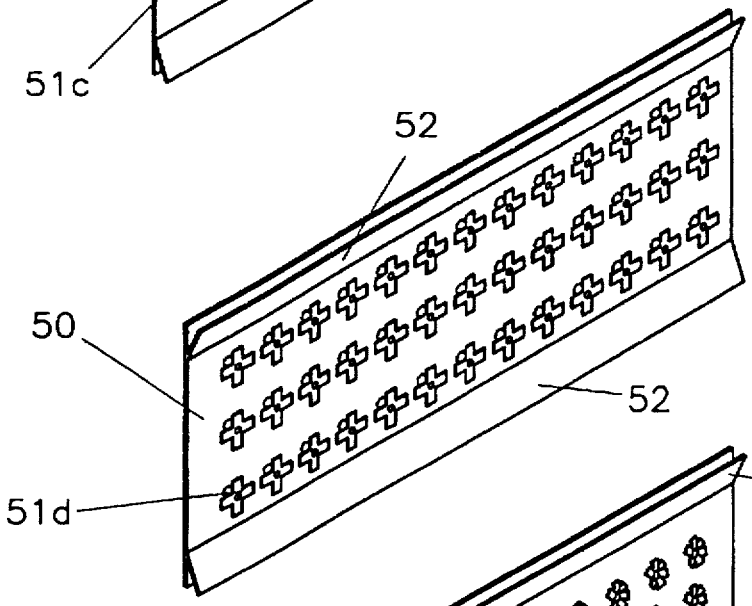
FIG. 7D is an elevational view of the embodiment showing the gusset sub-panels of the present invention including screw-locked retention sheets.
Figure 7E:
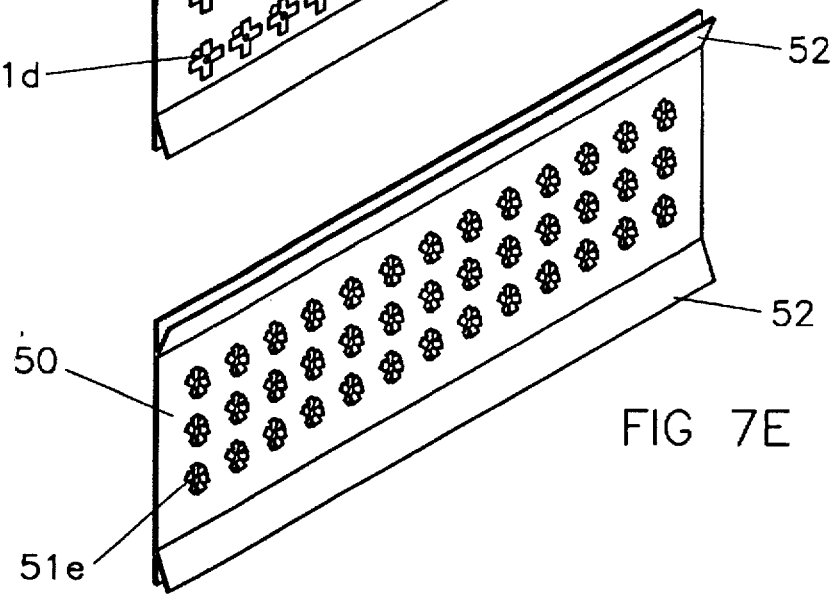
FIG. 7E is an elevational view of the embodiment showing the gusset sub-panels of the present invention including burst type bore holes.

Referring to FIG. 7, the catch or retention member has a "T" section and a long-bar retention sheet integrally formed with said gusset sub-panel 20. In addition, said retention member 51 is not limited to a "T-shape", but may be designed as inverted "L" retention member 51*a*, bevel retention member 51*b*, or hook retention member 51*c* as shown in FIG. 7A, 7B, 7C respectively, or other members to increase retention. In addition, retention members on the gusset sub-panel 50 may also be screwed to the gusset sub-panel. A number of "cross" retention sheets 51*d* maybe screwed onto the surface of the gusset sub-panel 50 as shown in FIG. 7D. The surface of said gusset sub-panel 50 may include number of bore holes to form "burst" holes 51*e* through outward bending of the irregular rim of the holes. A number of burst holes 51*e* can thus be provided as retention members as shown in FIG. 7E. The main advantage of the embodiment as shown in FIG. 7E, lies in the fact that the burst holes 51*e* may increase the bending strength of the gusset sub-panels 50 while the burst holes 51*e* appear irregular which diverts the internal stress on the face of the built-up wall to reduce cracking damage.

Figure 8:
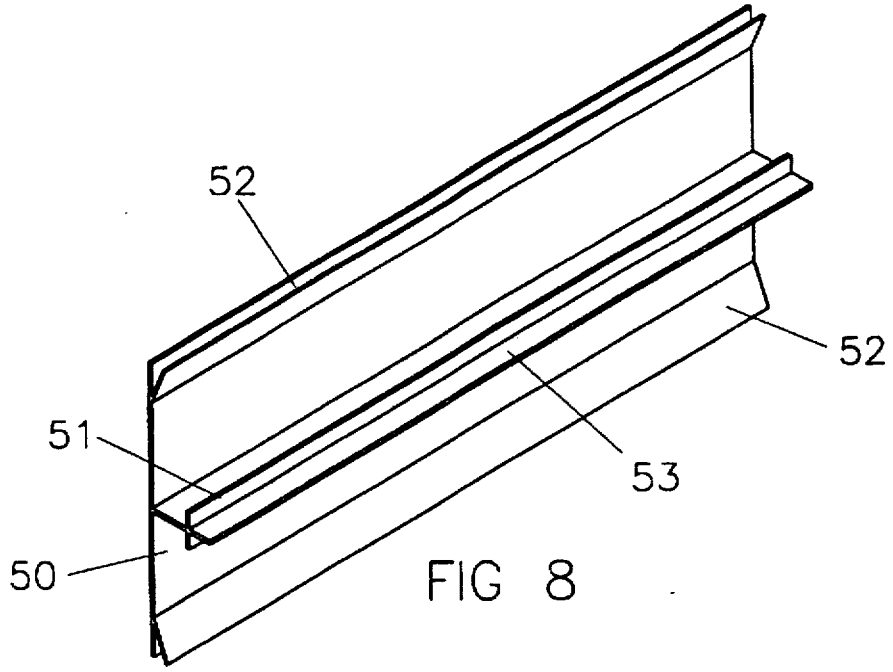
FIG. 8 is an elevational view of the embodiment showing the gusset sub-panels of the present invention including perpendicular sheets.

Referring to FIG. 8, the gusset sub-panel 50 also includes a level sheet 53. The level sheet 53 may be formed by extending the retention member 51. The height of the top edge of the level sheet is greater than the height of said retention member 51 and is perpendicular to the surface of said gusset sub-panel 50. Upon the construction of the present invention, the gusset sub-panel 50 with level sheet 53 may be positioned as required to offer a datum for the thickness of the slurry.

Figure 9:
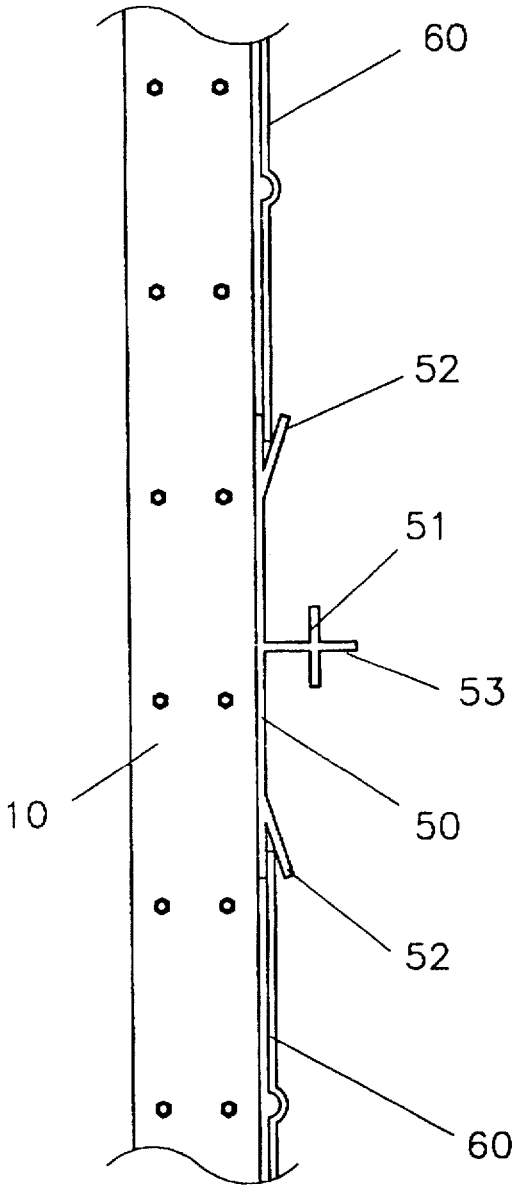
FIG. 9 is a side view of the base boards assembled together with gusset sub-panels according to the present invention.

Said gusset sub-panels 50 and base board sub-panels 60 may be parallel and alternately tied on the skeletal wall frame. Each gusset 50 can be fitted next to the base board sub-panel 60 by means of the lateral extension plate so that a number of base board sub-panels 60 can be set alternately between a number of gusset sub-panels 50 and be tied to the skeletal wall frame by means of screws or nails to form a firm wall structure (as shown in FIG. 9).

Figure 10:
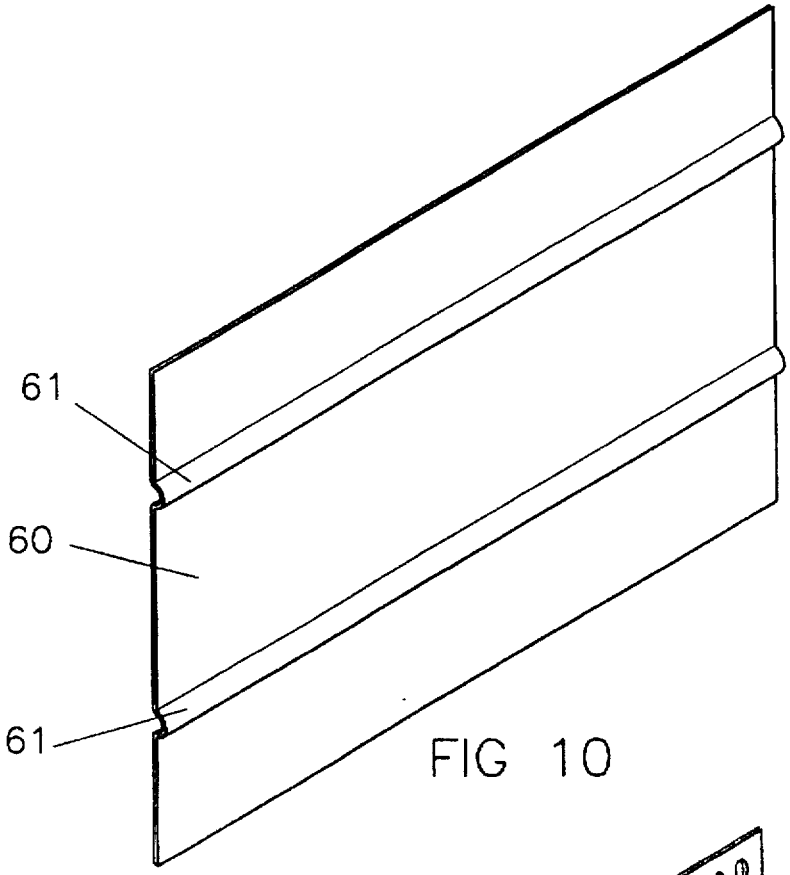
FIG. 10 is an elevational view of the base board sub-panels of the present invention.
Figure 11A:
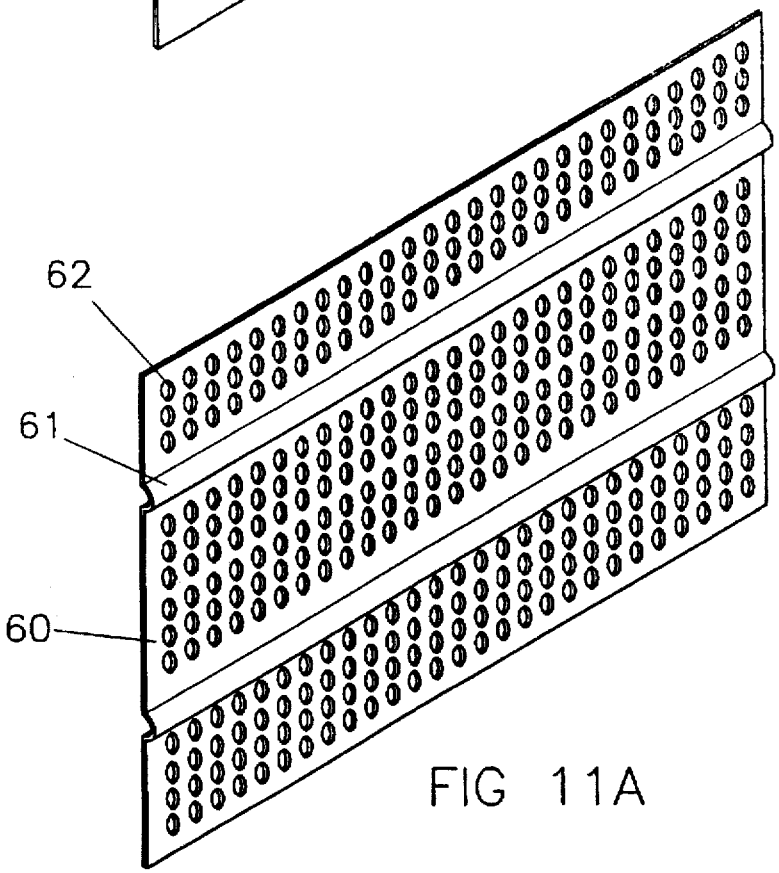
FIG. 11A is an elevational view of the embodiment for the bass board sub-panels of the present invention including holes to increase retention of slurry.
Figure 11B:
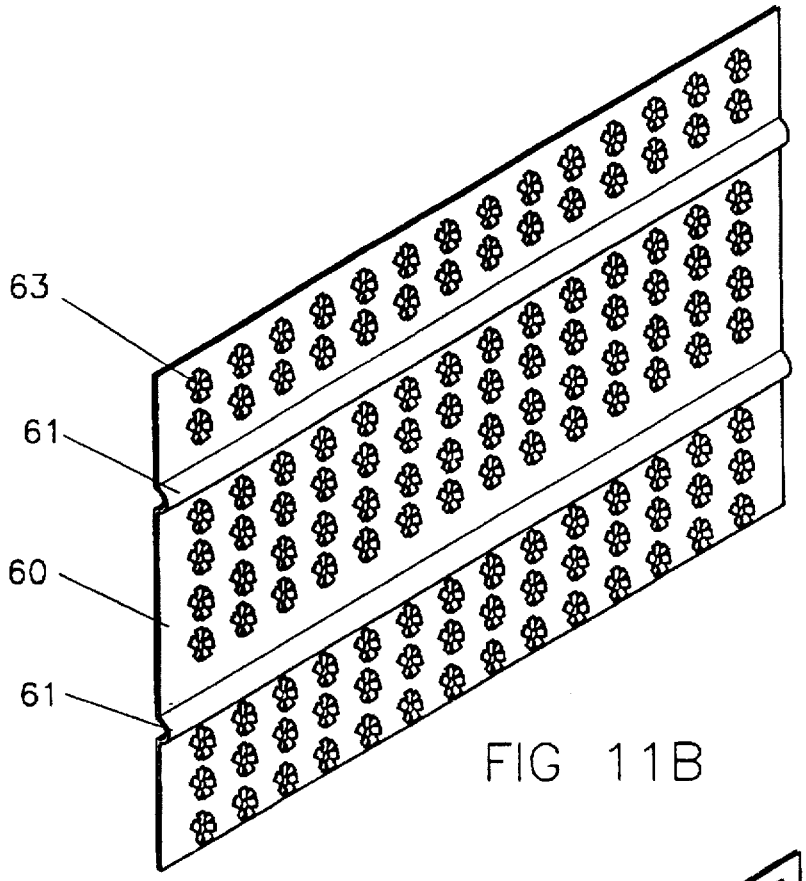
FIG. 11B is an elevational view of the embodiment for the base board sub-panels of the present invention including burst holes to increase retention of slurry.
Figure 11C:
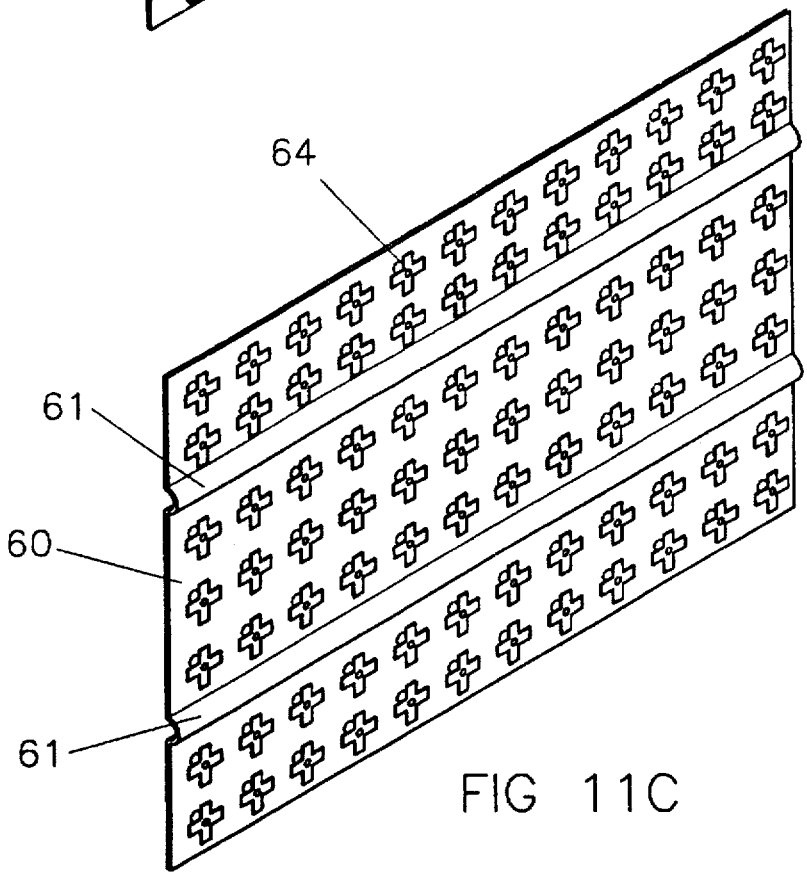
FIG. 11C is an elevational view of the embodiment for the base board sub-panels of the present invention including screw-locked retention sheets.

Referring to FIG. 10, the base board sub-panel 60 is formed by metal sheet cut to size. The width and length can be adjusted subject to requirements. The base board sub-panel 60 may be bent to form a number of ribs 61 for increasing bend resistance of the base board sub-panel 60. In addition, said base board sub-panel 60 may include a device for increasing its slurry retention as shown in FIG. 11A. The base board 60 has a number of holes 62 for increasing its slurry retention. As shown in FIG. 11B the surface of the base board sub-panel 60 is made with a number of burst holes 63 and outward bending of the holes to form burst holes 63 for retention slurry. As shown in FIG. 11C, the surface of the base board sub-panel 60 may be screwed with retention sheet 64 to carry out the above function.

Upon installation of said gusset sub-panel 50 and base board sub-panel slurry may be applied to the wall face. Because gusset sub-panel 50 have level sheets 53, troublesome work of wiring up parallel points according to conventional wall construction can be omitted to reduce work deviation and material waste.

Figure 12:
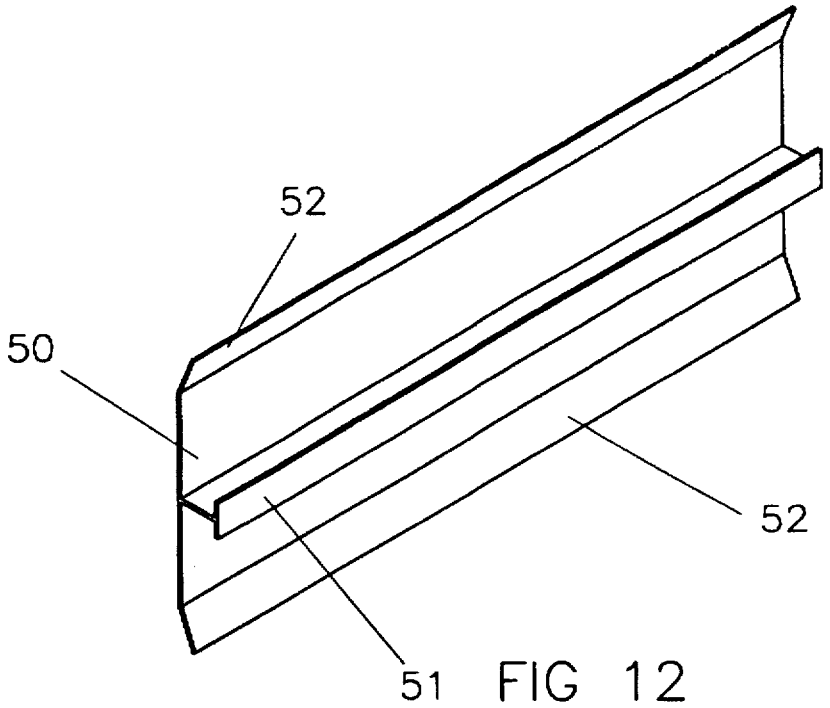
FIG. 12 is an elevational view of the embodiment, showing extension plates directly formed by bending an edge of the gusset sub-panels.
Figure 13:
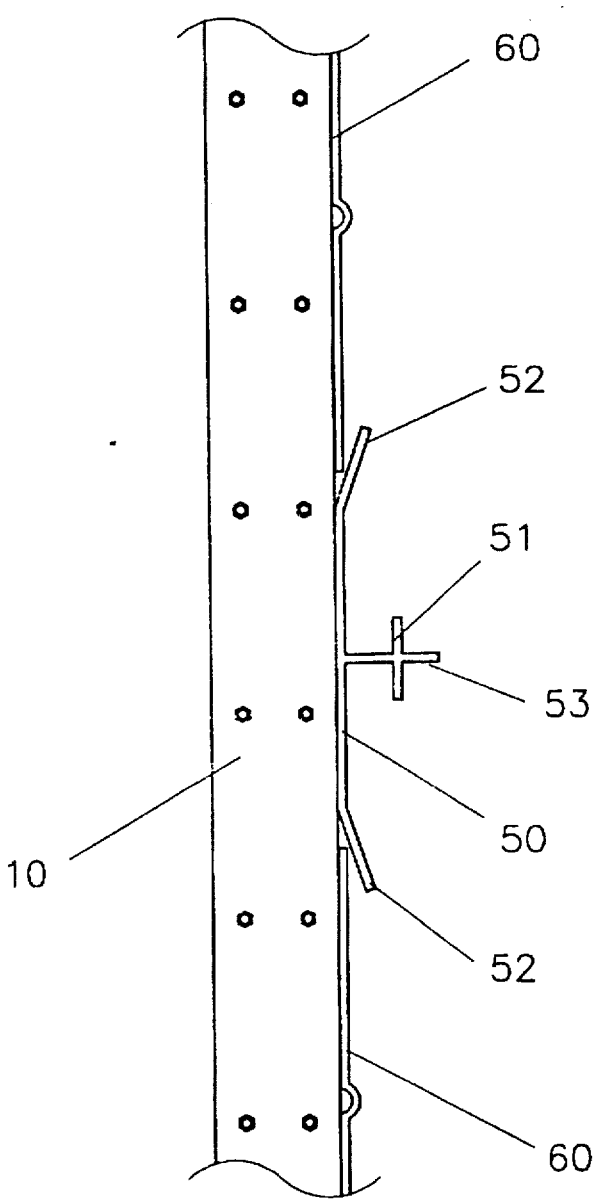
FIG. 13 is a partial side view of gusset sub-panels shown in FIG. 12 in combination with base board sub-panels.

In addition, gusset sub-panel 50 and base board sub-panel 60 of the present invention may further be changed as shown in FIG. 12. The extension plate 52 of gusset sub-panel 50 can be formed by upward bending of the edge of the gusset sub-panel 50. It will be much easier to make such a structure because it is only necessary to bend the gusset sub-panel to form the extension plate 52. Referring to FIG. 13, the height of the extension plate 52 is greater than the thickness of said base board 60. Therefore once the gusset sub-panel is locked to the skeletal wall frame, a spacing is defined between a surface of said extension plate 52 and the skeletal frame 10. When the edge of the base board sub-panel 60 is inserted in the space the extension plate may press down the edge of the base board sub-panel 60 to fix it to the skeletal whereby the gusset sub-panel 50 and base board sub-panel 60 can be firmly connected side by side. The other advantage of the gusset sub-panel 50 arranged in such a manner is that resilient flexibility can be obtained from the match of the base board sub-panel 60 with the gusset sub-panel 50. When said base board sub-panel 60 is too wide or involves flexing in order to place the edge of the base board sub-panel 60 under said extension plate 50, the edge of the base board sub-panel 60 is flexible enough to place in position under the gusset sub-panel.

Figure 14:
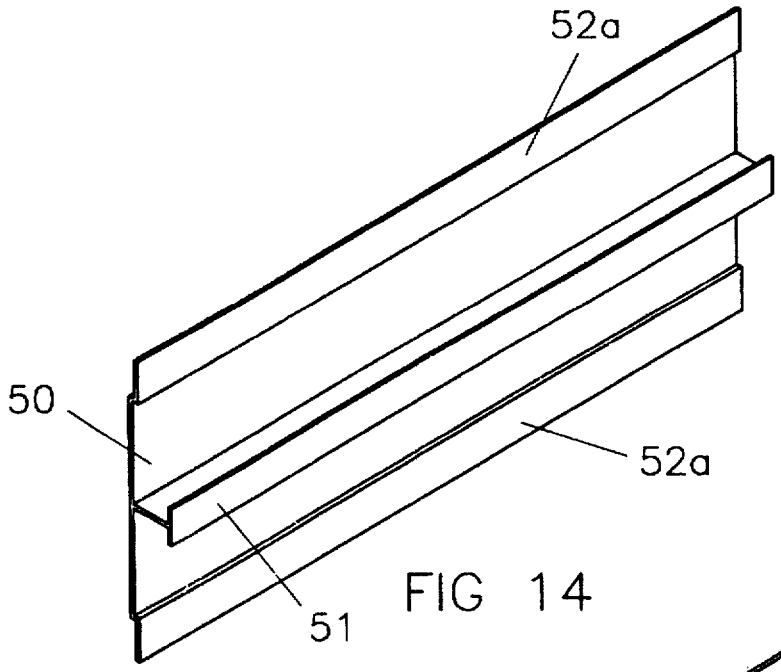
FIG. 14 is an elevational view of another structure of gusset sub-panels with extension plates.

The structure of the extension plate 52 is not limited to the bevel shaped extension plate mentioned above, as shown in FIG. 14, the edge of gusset 50 is bent upwards and then parallel with the sub-panel to form an "L" shaped extension plate 52*a*.

Figure 15:
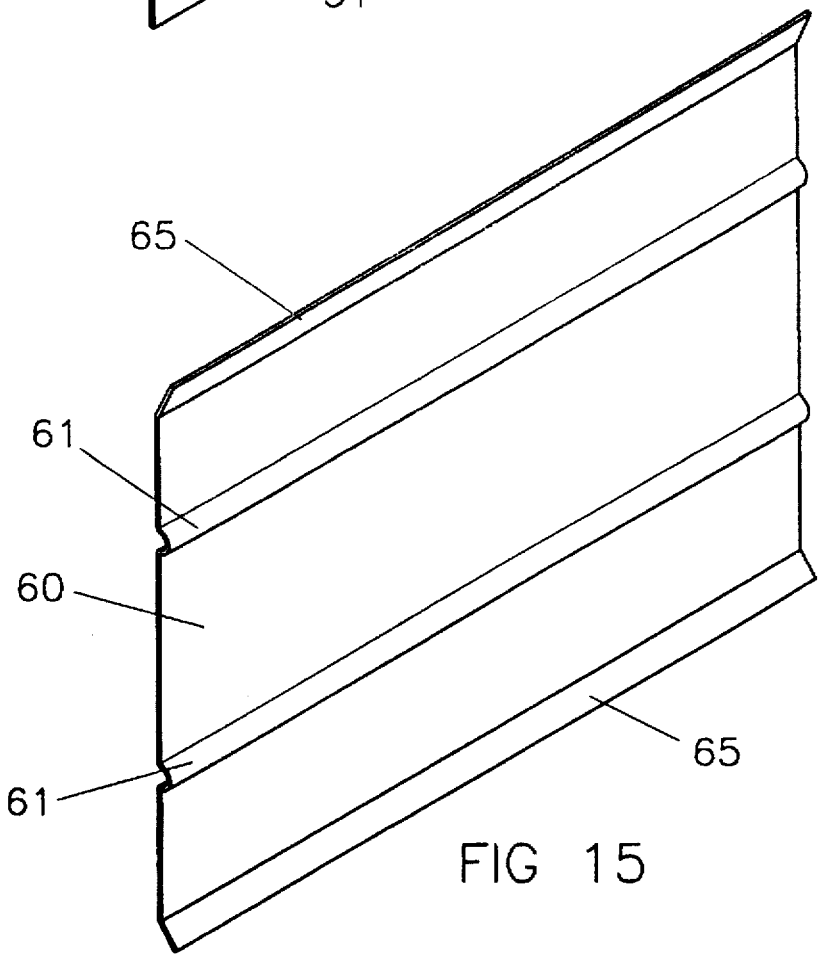
FIG. 15 is an elevational view of the embodiment, showing extension plates located by the side of the base board sub-panels.
Figure 16:
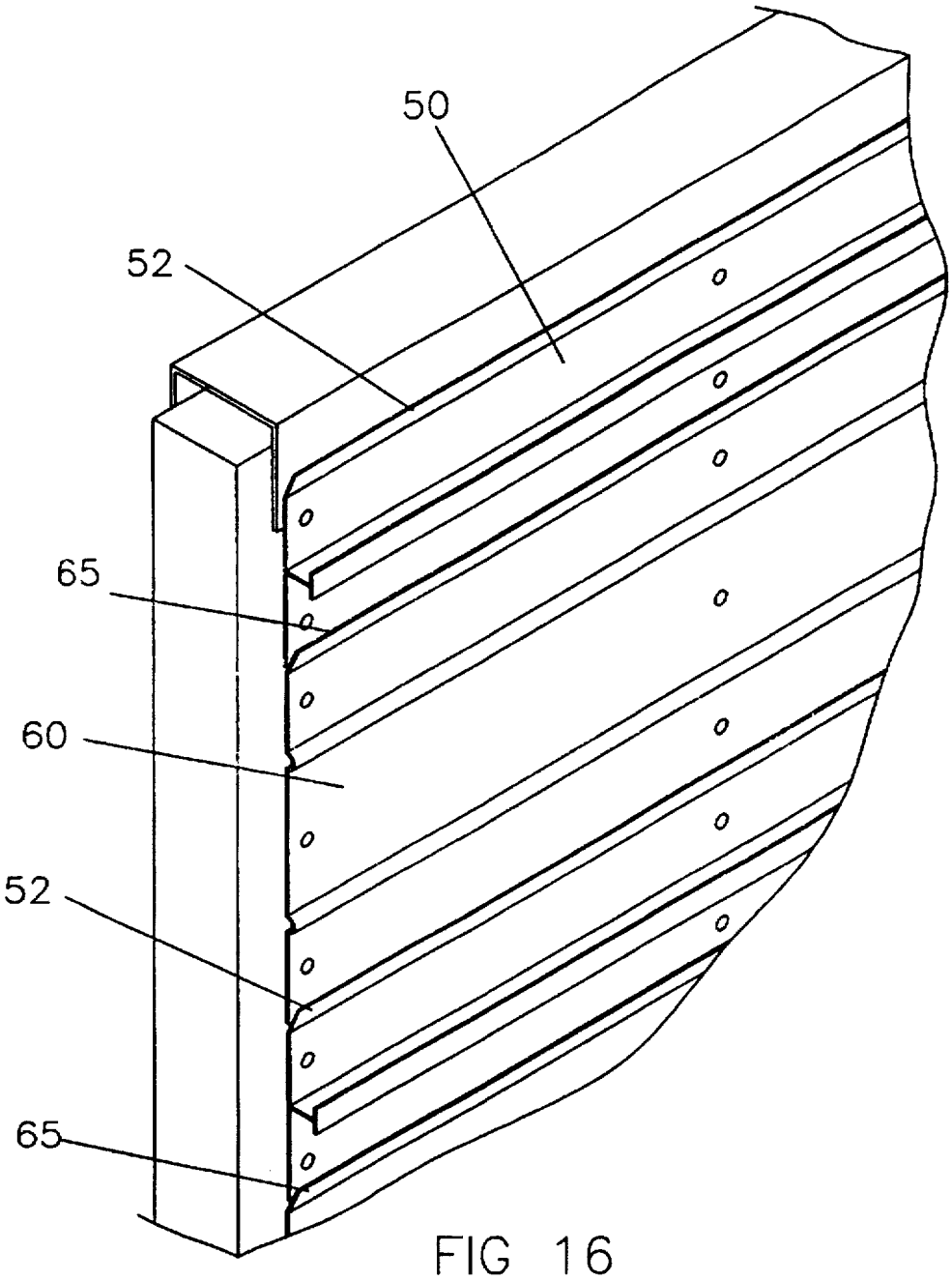
FIG. 16 is an elevational view of the embodiment, showing gusset sub-panels and base board sub-panels with extension plates.

In addition, the location of said extension plate 52 may be varied as shown in FIG. 15. Each edge of said base board sub-panel 60 is bent to form an extension plate 65 in place of the extension plate 52 mounted on said gusset sub-panel 50. Referring to FIG. 16, only one edge of said gusset sub-panel has an extension plate 52 while said base board sub-panel 60 also has an extension plate 65 on single edge so that base board sub-panel 60 and gusset sub-panel 50 can be connected to each other.

The gusset sub-panel 50 and base board sub-panel 60 may include a retention member for increasing the retention of slurry thereby enabling slurry on the wall face to firmly bind with said gusset sub-panel 50 and said base board sub-panel 60. The gusset sub-panel 50 may connect with the base board sub-panel 60 by means of the extension plate to enable the junction between the sub-panel to be resistant to relative movement. Better integrity may be obtained, whereby the wall face of the present invention is superior to conventional walls with respect to strength and integrity.

Figure 18:
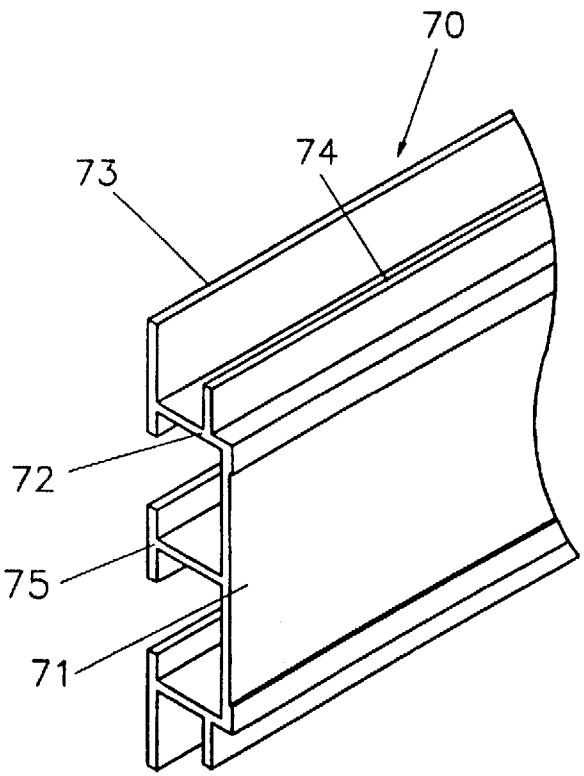
FIG. 18 is an elevational view of the protection plate of the present invention.
Figure 17:
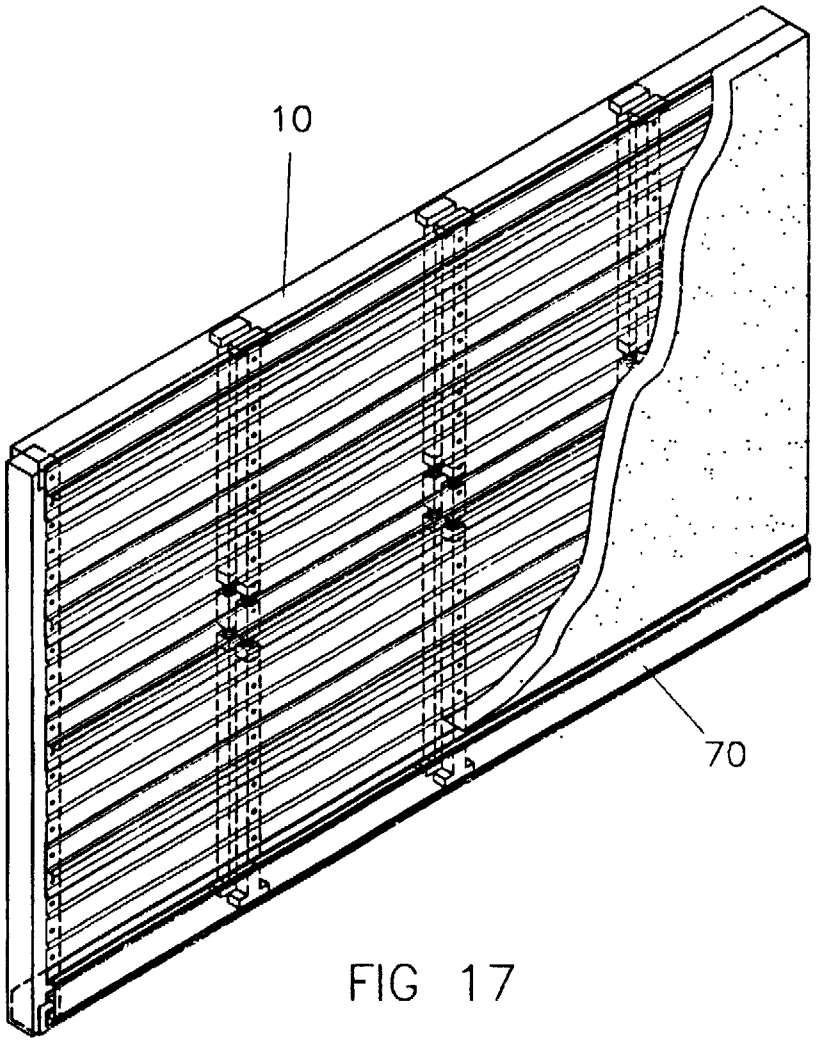
FIG. 17 is an elevational view of the embodiment, showing the portion of wall likely to be hit having a protection plate.

Referring to FIG. 17, a protection plate 70 may be mounted on the portion of the wall most likely to be knocked. The protection plate 70 can be tied to said gusset sub-panel 50 and base board sub-panel 60 to form an integral part of the wall face. Referring to FIG. 18, a protection plate 70 of the present invention includes a panel 71 resembling a plate made from high strength material. The panel may also include surface decoration sheets or shock-absorption material or buffer material. Two inlayed plates 72 may extend from an edge of said panel 71. This edge may include a base plate 73 parallel to the panel 71, and each edge may include a number of retention plates 74. This assembled structure including the protection plate 70 will be firmly located on the wall face and a number of said retention plates 74 may increase the retention of said inlayed plates 72 will in the slurry on the wall face with a reduced risk of them coming off. The real face of said panel 71 between said two inlayed plates 72 has a number of support members 75 formed in a T shape for enabling the protection plate 70 to be mounted in the wall more securely.

The present invention is a major breakthrough in the construction of wall structures. It has advantages and characteristics listed below:

1. High structural strength, shock resistance and bump resistance:

The present invention uses an extension plate 52 of gusset sub-panel 50 for fastening the edge of base board sub-panel 60 so that the sub-panels are secure for achieving high integrity. Retention member 51 on said gusset sub-panel 50 may increase retention of slurry on the sub-panels so that the wall face of the present invention is solid and not easily damaged. The wall structure has excellent shock-proof ability. The protection plate 70 may protect the wall face against bump damage so that the durability of the wall structure is better than conventional wall structures.

2. Quick construction, large flexibility of application:

The built up post 11 of the present invention can be assembled quickly and offers flexibility in its applications. Further because said gusset sub-panel 50 has level sheets 53, the troublesome task of forming a level datum can be omitted. Because said base board sub-panel 60 can be cut to fit the size of wall face, assembly becomes easy and flexibility is increased.

Although in this specification and claims particularly reference has been made to the use of steel in the manufacture of components including gussets, base boards, posts and built-up posts of a skeletal wall panel which is faced with concrete applied as a slurry, if desired, the aforesaid metal components may be made from appropriate structural plastics materials. Further, if desired, the concrete facing may be replaced by a resinous composition, such as an epoxy or polyester resin composition which may be reinforced using glass fibre.

Many changes, modifications, variations and other uses and applications of the subject invention will however, become apparent to those skilled in the art after considering the foregoing specification together with the accompanying drawings. All such changes, modifications, variations and other uses and applications which do not depart from the spirit and scope of the invention are deemed to be covered by the invention which is limited only by the claims which follow.

I claim:

1. A light weight wall structure having a protection plate for a building including:

a skeletal frame having a plurality of posts for quick assembly;

a plurality of gusset sub-panels and base board sub-panels disposed in overlapping and alternate relationship fastened to the skeletal frame;

a connection means provided in each junction between adjacent sub-panels for securely adjoining the sub-panels together;

a slurry retention device disposed on at least one major surface of a selected number of sub-panels; and a wall facing layer applied to the sub-panels in the form of a setable slurry, so as to increase the strength of the wall structure; and a protection plate mounted on one of said sub-panels on a portion of said wall structure that is most likely to be damaged, said protection plate comprising a protection panel, two inlaid plates extending on both edges of said protection panel, respectively, a base plate at an end of said inlaid plate parallel to said protection panel for retaining said inlaid plates in said wall facing layer.

2. The light weight wall structure according to claim 1 wherein each of said posts comprises:

an upper post resembling a long column, said upper post having a first end fixably connected to an upper girder or upper floor of a building and a second end with a longitudinal hole, said longitudinal hole having an inner wall with an internal thread;

a lower post resembling a long column, said lower post having a first end fixably connected to a lower girder or lower floor of a building and a second end with a longitudinal hole, said longitudinal hole having an inner wall with an internal thread; and an intermediate post resembling a long column, said intermediate post having first and second end each having a long thread for screwing into said longitudinal holes of said upper and lower posts, respectively; and said long thread is a right-handed thread on one end of said intermediate post, and is a left-handed thread on the other end, such that turning said intermediate post enables said upper and lower posts to produce longitudinal movement relative to each other.

3. The structure as claimed in claim 1 wherein the slurry retention device on said gusset sub-panel has the shape of a retention sheet for catching slurry.

4. The structure as claimed in claim 3 wherein the shape of the retention sheet is selected from the group consisting of T shape, bevel shape, hook shape, and winding shape.

5. The structure as claimed in claim 1 wherein said base board sub-panel includes at least one rib to increase bending strength thereof.

6. The structure as claimed in claim 1 wherein the surface of said base board sub-panel has at least one second retention member to increase retention of slurry.

7. The structure as claimed in claim 6 wherein each of the second retention members on said base board sub-panel comprises a plurality of holes.

8. The structure as claimed in claim 1 said connection means is an extension plate extending from the edge of the gusset sub-panel or base board sub-panel, said extension plate has a height sufficient for inserting an edge of another plate under said extension plate.

9. The structure as claimed in claim 8 wherein said extension plate is located along an edge of said gusset sub-panel.

10. The structure as claimed in claim 1 wherein said gusset sub-panel has a surface provided with a leveling device for defining a thickness of the slurry.

11. The structure as claimed in claim 1 wherein said protection panel further comprising at least one retention plate extending from and perpendicular to said inlaid plate for increasing a retention of said inlaid plates in said wall facing layer.

* * * * *